US008113587B1

(12) United States Patent
Zarinfar et al.

(10) Patent No.: US 8,113,587 B1
(45) Date of Patent: Feb. 14, 2012

(54) PORTABLE LIFT CHAIR

(76) Inventors: Majid Zarinfar, Central Islip, NY (US); Henry de la Rosa, Smithtown, NY (US)

( * ) Notice: Subject to any disclaimer, the term of this patent is extended or adjusted under 35 U.S.C. 154(b) by 109 days.

(21) Appl. No.: 12/687,022

(22) Filed: Jan. 13, 2010

(51) Int. Cl.
*A61G 3/00* (2006.01)
*A61G 5/00* (2006.01)
*A47C 7/00* (2006.01)
*A47C 4/00* (2006.01)

(52) U.S. Cl. ..... 297/337; 297/440.2; 297/440.22; 297/440.14; 297/47; 297/DIG. 10

(58) Field of Classification Search ..... 297/335, 297/336, 326, 47, 16.1, 440.22, DIG. 10, 297/440.2, 440.14, 130, 337
See application file for complete search history.

(56) References Cited

U.S. PATENT DOCUMENTS 2,442,303 A 5/1948 Mayfield
3,123,400 A 3/1964 Paulson
3,158,398 A * 11/1964 Stryker ..... 297/333
4,884,841 A * 12/1989 Holley ..... 297/331
5,161,812 A 11/1992 DeWeese
5,176,355 A 1/1993 Carter
5,346,280 A 9/1994 Deumite
D358,203 S 5/1995 Smith
5,626,389 A 5/1997 Logan, Jr.
5,984,418 A * 11/1999 McInturff ..... 297/440.24
6,540,250 B1 * 4/2003 Peterson ..... 280/657
7,000,988 B2 * 2/2006 Bressler et al. ..... 297/325
7,377,589 B1 * 5/2008 Glater ..... 297/440.14
2004/0026977 A1 2/2004 Vaughan
* cited by examiner

*Primary Examiner* — Milton Nelson, Jr.
(74) *Attorney, Agent, or Firm* — Michael I. Kroll

(57) ABSTRACT

A portable lift chair has a lightweight frame with a pair of cross members extending from opposing sides thereof from front to back in a substantially X-shaped configuration, with the cross members pivotally secured to one another and to the front portion of the frame by a pivoting linkage, a seat base, a pivotable bracket connecting the front portion of the seat base to the frame, a weight adjustable pressurized cylinder providing an upward bias to the rear portion of the seat base, a removable back rest, and a guide track with an actuator for moving the weight adjustment bracket from one anchor point to another as desired to achieve a predetermined pressure for the seat.

18 Claims, 9 Drawing Sheets

PORTABLE LIFT CHAIR

BACKGROUND OF THE INVENTION

1. Field of the Invention

The present invention relates generally to chairs and, more specifically, to a portable lift chair comprising an extendable collapsible lightweight frame with one or more wheels fastened to the rear of the frame providing means for porting the chair to a desired location.

The seat portion is pivotally hinged toward the front of the frame with at least one hydraulic or pneumatic device applying a force toward the rear of the seat so that in the non-operative position the seat member has a positive slope providing a user with a controlled decent to a seated position and a lifting force while standing from said chair. The hydraulic or pneumatic device is connected to the front of the chair frame through a pivotal bracket that aids in folding the chair to its compact state. And is connected to a bracket on the backside of the seat. Additionally, the seat may be detachable so that other types of seat may be inserted for other purposes, such as having a seat with an aperture passing therethrough for use of a bed pan or chamber pot.

The present invention provides that the backside bracket may incorporate a plurality of attachment points providing a user selectable force during pivotal movement of the seat. The aforementioned attachment points may include a fastener and a series of spaced apart apertures with the fastener inserted through a desired aperture or the hydraulic/pneumatic device may incorporate selectable apparatus for designating a desired operative force.

Furthermore, the present invention also provides arm rests on each side of the seat to aid the user during the task of sitting and standing, and it is envisioned that the arm rests may have in whole or in part some padding thereover.

2. Description of the Prior Art

There are other chairs devices designed for lifting. Typical of these is U.S. Pat. No. 2,442,303 issued to Mayfield on May 25, 1948.

Another patent was issued to Paulson on Mar. 3, 1964 as U.S. Pat. No. 3,123,400. Yet another U.S. Pat. No. 4,884,841 was issued to Holley on Dec. 5, 1989 and still yet another was issued on Nov. 10, 1992 to DeWeese as U.S. Pat. No. 5,161,812.

Another patent was issued to Carter on Jan. 5, 1993 as U.S. Pat. No. 5,176,355. Yet another U.S. Pat. No. 5,346,280 was issued to Norman A. Deumite on Sep. 13, 1994. Another was issued to Smith on May 9, 1995 as U.S. Pat. No. Des. 356,203 and still yet another was issued on May 6, 1997 to Logan, Jr. as U.S. Pat. No. 5,626,389.

Another was published to Vaughan on Feb. 12, 2004 as U.S. Patent Application No. 2004/0026977 and still yet another was issued on Feb. 21, 2006 to Bressler et al. as U.S. Pat. No. 7,000,998.

A chair of the nature described comprising a leg frame, a cross rung between the legs thereof, a shackle link pivotally secured adjacent one end of said cross rung a vertically disposed back member pivotally mounted on the other end of said shackle link a seat pivotally secured at each end to said back and said leg frame respectively and means pivotally secured to said cross rung and said seat at each end thereof for urging the said seat arcuately upward and the said back vertically upward.

An invalid's chair including a wheeled chassis, a turntable mounted for rotation on said wheeled chassis, a chair comprising a seat and a back, a hydraulic jack between the back and the turntable, said hydraulic jack including a cylinder fixedly secured at its lower end to the turntable, a piston in said cylinder, a pump for pumping fluid within the cylinder to raise the piston, a piston rod secured to the piston, means between the piston rod and the chair back to permit limited sidewise tipping of the chair, said chair back being provided with spaced apart front and rear panels and narrow side panels joining the front and rear panels and terminating short of the lower end of the cylinder, stabilizing mechanism between the chair seat and the turntable to resist said tipping of the chair, and means conveniently located with respect to a person seated in the chair for controlling the up and down movement of the piston and the chair.

A device for assisting invalids into and from a seated position, e.g., over a toilet. The device has a frame and a seat hingedly attached at the front thereof to a support member which is vertically slidable on the frame. A stop is associated with the hinge to prevent the seat from pivoting below the horizontal attitude. An extendable arm is connected at one end to the frame and, at the other end thereof, to the seat between the hinge and the center of gravity. Control means selectively activates extension of the arm to initially vertically elevate the seat in the horizontal attitude, and then to pivot the seat upwardly to assist an individual seated thereon into a standing position; or activates retraction of the arm to initially pivot the seat into a horizontal attitude, and then to vertically lower the seat in a horizontal attitude to assist an individual into a seated position. The extendable arm may be electrically, pneumatically or hydraulically operated, and the device may be portable and adapted to be positioned over a conventional toilet.

The invention is an improved wheel chair in which the seat may be raised or lowered by a hand powered hydraulic ram mechanical means to levels that match the surface of the chair or bed to which the patient is being transferred. A commode function is also provided. The chair comprises a base having swivel casters and fixed wheels, an upper unit having a seat and backrest and a hydraulic pump, and a seat raising mechanism consisting of four pairs of interconnected levers connected by two cross bars in such a way that when the bars are pushed apart by a hydraulic ram, the separating motion is amplified to give the desired range of chair seat travel height.

The housing of an air valve, the valve controlling the height of a vehicle seat supported on a suspension having an air spring, is pivotally connected to one of the frames of the suspension supporting the seat. A manual control lever connected to the housing is operative to change the angle of inclination of the housing for selecting a desired height of the seat. A control arm of the valve is connected by a linkage to the other frame of the suspension. These connections to the air valve control the valve for selecting a desired height and for automatically restoring the height for different weights on the seat.

A chair with an automatic standing aid and a wheelchair which incorporates these features are provided. These chairs can raise or lower an occupant automatically while compensating for the change in the center of gravity with stabilizers. The stabilizers allow the chairs to be lightweight, small in size, and independent of heavy supporting bases. The chairs can be used to replace those on existing wheelchair power bases.

The ornamental design for an invalid lifter for toilets, as shown and described.

A lift seat includes a seating surface, for example, a toilet seat, mounted on a supporting frame by a four-bar linkage. The four-bar linkage includes a lower link fixed to the frame and an upper link fixed to the seat. An armrest is attached to a front link of the four-bar linkage for pivoting therewith against the bias of the spring which loads the four-bar linkage as the seat is lowered from a raised position in a seating position. Energy stored in the spring is then available to lift the person from the seating position back to the raised position. A damper is connected to the four-bar linkage to prevent abrupt movement of the seat as the four-bar mechanism collapses and expands, while a gas spring is provided to initially resist movement of the four-bar linkage from either the expanded or the collapsed condition unless the armrest is initially rotated.

A lifting device suitable for assisting the elderly, invalids or those recuperating from surgery to rise from a seated position to a standing position includes a rigid base (2) connected by a hinge (4) to a rigid seat (3). A closed bag (5) is interposed between and is secured to the base (2) and seat (3). By inflating the bag (5) the seat may be raised from a substantially horizontal position to a raised position to assist a seated person to rise to a standing position. A cushion (17) may be provided on the seat (3). The device may be used in reverse to assist a user in moving from a standing position to a seated position. A suitable inflation pump and control gear is provided to admit air to and remove air from the bag (5) via a tube (12).

A chair is operable between a seating position and a rise-assist position. The chair comprises a base; first and second legs; a seat pivotally connected to the first and second legs; and a back pivotally connected to the seat. The chair further comprises first and second members pivotally connected at a first end to the legs, and pivotally connected at a second end to the back. At least portions of the legs, first and second members, back and seat form first and second four-bar linkages, respectively. At least one biasing member is pivotally connected at a first end to one of the base and at least one of the legs and pivotally connected at a second end to at least one of the four-bar linkages. The at least one biasing member operates to assist movement of the chair between the seating position and the rise-assist position.

While these chairs may be suitable for the purposes for which they were designed, they would not be as suitable for the purposes of the present invention, as hereinafter described.

SUMMARY OF THE PRESENT INVENTION

A primary object of the present invention is to provide a portable lift chair for aiding users in sitting in and standing from said chair.

Another object of the present invention is to provide a portable lift chair having a lightweight frame reducing the effort of using and porting said chair.

Yet another object of the present invention is to provide a portable lift chair having a pivotal seat incorporating at least one hydraulic or pneumatic device for controlling the descent rate of the seat while entering said chair.

Still yet another object of the present invention is to provide a portable lift chair having a pivotal seat incorporating at least one hydraulic or pneumatic device for applying an upward force on the seat while exiting said chair.

Another object of the present invention is to provide a portable lift chair having a plurality of wheels to aid in moving the chair from one location to another.

Yet another object of the present invention is to provide a portable lift chair having a seat with arm rest to aid the user in sitting in and exiting from said chair.

Still yet another object of the present invention is to provide a portable lift chair wherein said seat is detachable for use of other seat members.

Additional objects of the present invention will appear as the description proceeds.

The present invention overcomes the shortcomings of the prior art by providing a portable lift chair comprising an extendable collapsible lightweight frame with one or more wheels fastened to the rear of the frame for porting the chair to a desired location. A seat portion pivotally hinged at the front of the frame having at least one hydraulic or pneumatic device for applying a force toward the rear of the seat so that in the non-operative position the seat is in a sloped position to control the rate of descent of the seat and to provide a lifting force while standing up from said seat.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
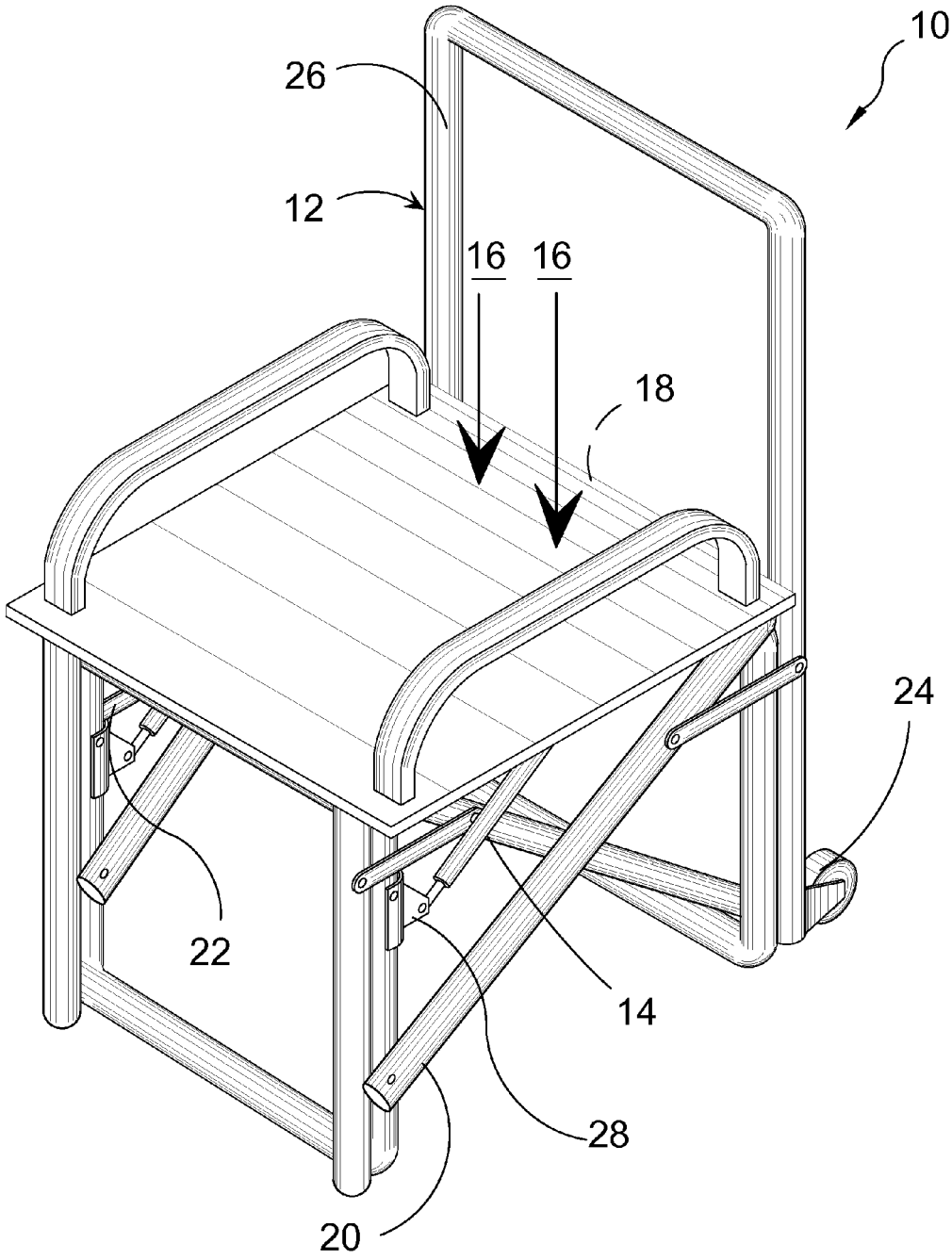
FIG. 1 is a perspective view of the portable lift chair in use.

Turning now descriptively to the drawings, in which similar reference characters denote similar elements throughout the several views, the figures illustrate the Portable Lift Chair of the present invention. With regard to the reference numerals used, the following numbering is used throughout the various drawing figures.

10 Portable Lift Chair of the present invention
12 foldable chair
14 pneumatic/hydraulic cylinder
16 user's weight
18 seat stop
20 cross member
22 linkage
24 wheel
26 frame of 12
27 pivotable bracket
28 linkage bracket
30 seat member

32 weight adjustment bracket
34 handle
36 seat backrest
38 surface
40 seat base
42 aperture
44 rigid planar seat base
46 padded seat base
48 retainer
50 guide track
52 actuator

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is a perspective view of the portable lift chair 10 in use. Shown is the present invention 10 comprising a foldable chair 12 having pneumatic or spring based cylinders 14 in order to tilt the seat base 22 in a manner that aids and assists a user in the act of sitting in and exiting from the chair. Also shown is the user's weight 16 compressing the seat stop 18 to the frame 26 to close the linkage 18, swivel the linkage bracket 28 and related cross member 20. The linkage 22 is adapted to fit the frame 26 which includes wheels 24 for ease in transporting.

Figure 2:
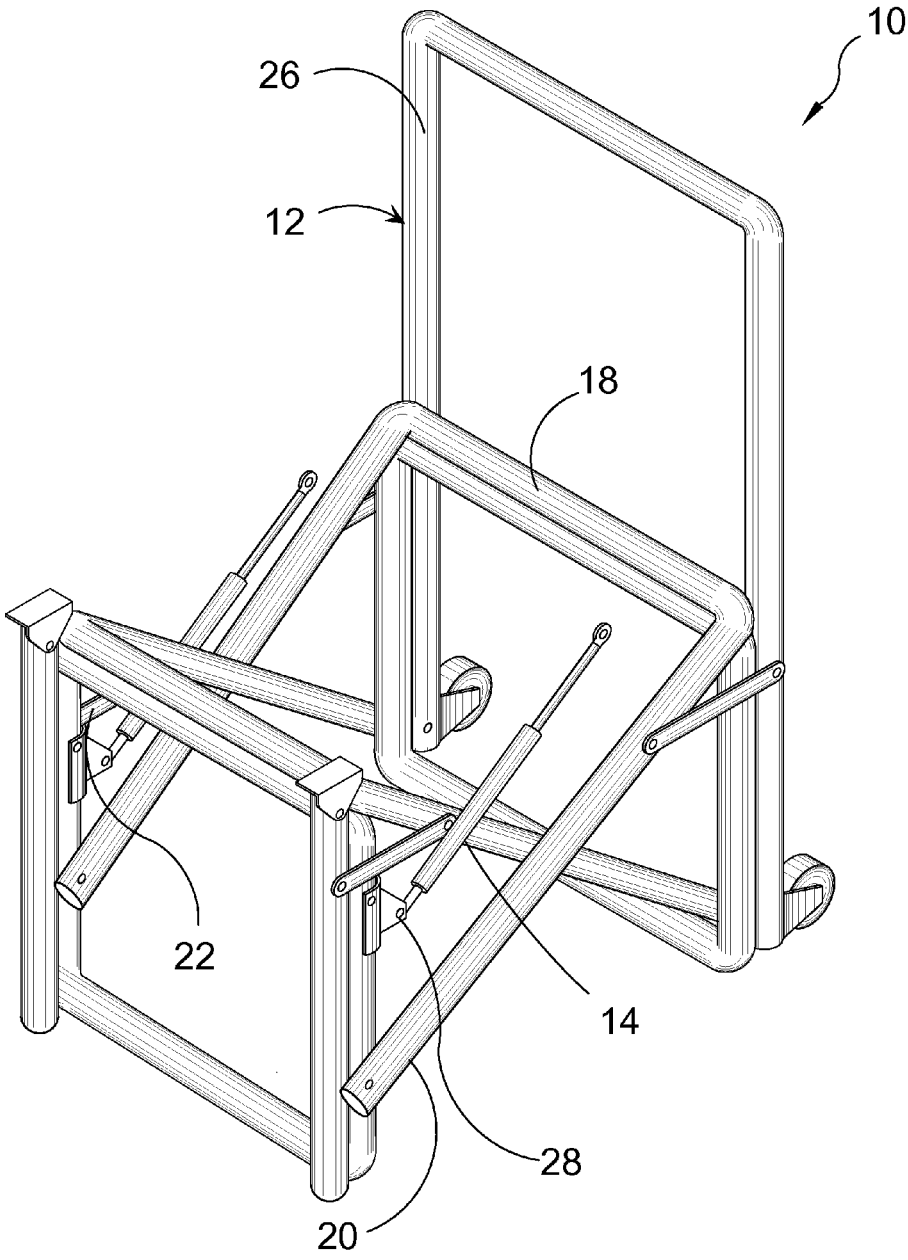
FIG. 2 is a perspective view of the portable lift chair frame.

FIG. 2 is a perspective view of the portable lift chair 10. Shown is the portable lift chair frame 26 in its extended position with the seat removed to reveal the seat stop 18. The hydraulic or pneumatic device 14 applies a force toward the rear of the seat so that in the non-operative position the seat member has a positive slope providing a user with a controlled descent to a seated position and a lifting force while standing up from said chair. The hydraulic or pneumatic device 14 is connected to the front of the chair frame through a linkage bracket 28 that aids in folding the chair to its compact state and is connected to a bracket on the backside of the seat shown in FIG. 3. The linkage 22 and cross members 20 are also shown.

Figure 3:
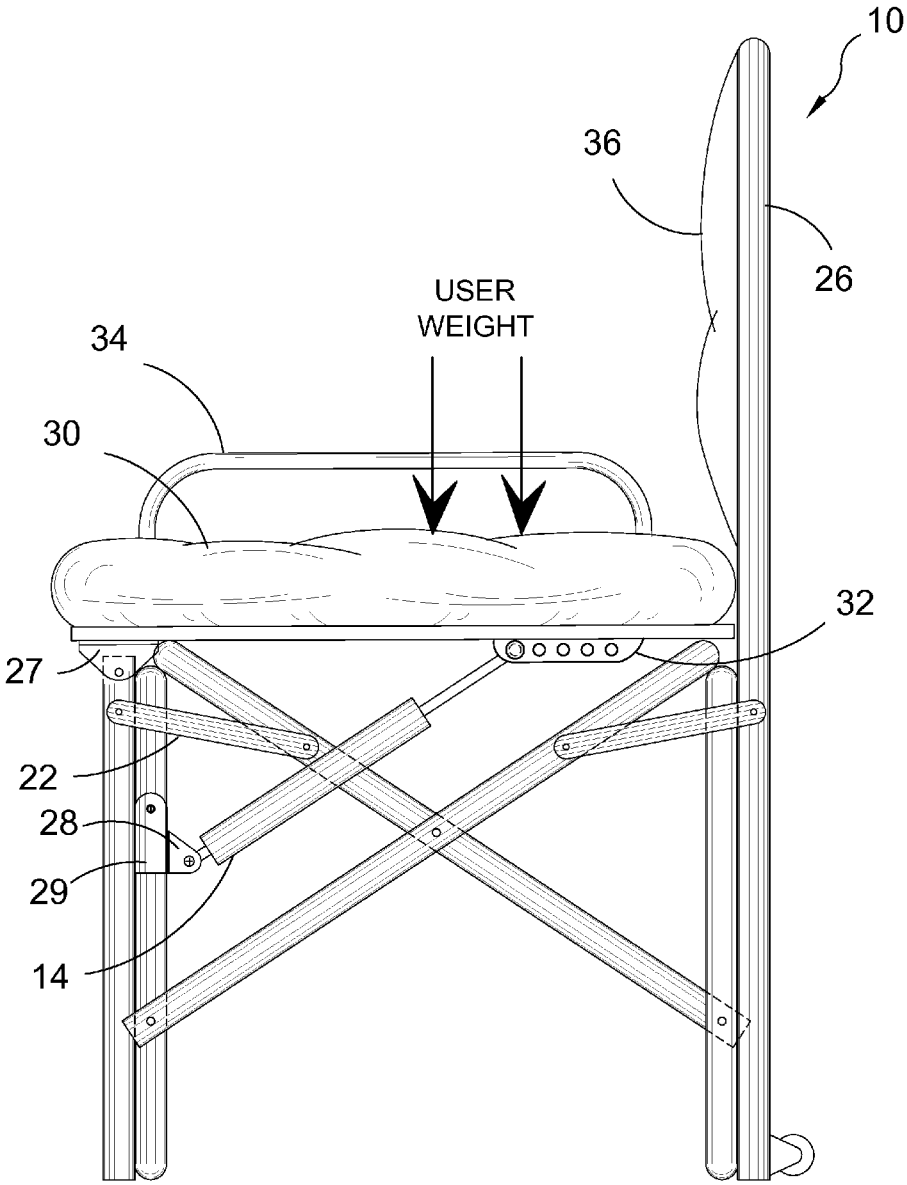
FIG. 3 is a side view of the portable lift chair.

FIG. 3 is a side view of the portable lift chair 10. Shown is the portable lift chair in its extended position. The hydraulic or pneumatic device 14 applies a force toward the rear of the seat so that in the non-operative position the seat member 30, via pivotal bracket 27, has a positive slope providing a user with a controlled descent to a seated position and a lifting force while standing from said chair. The hydraulic or pneumatic device 14 is connected to the front of the chair frame 26 through linkage bracket 28 that aids in folding the chair to its compact state and is connected to a weight adjustment bracket 32 on the backside of the seat that provides a plurality of attachment points to vary the descent and lifting rate of the seat. Linkage bracket 28 has a U-shaped portion 29 engaging frame 26. Handles 34 and a seat back 36 are provided for the user's comfort.

Figure 4:
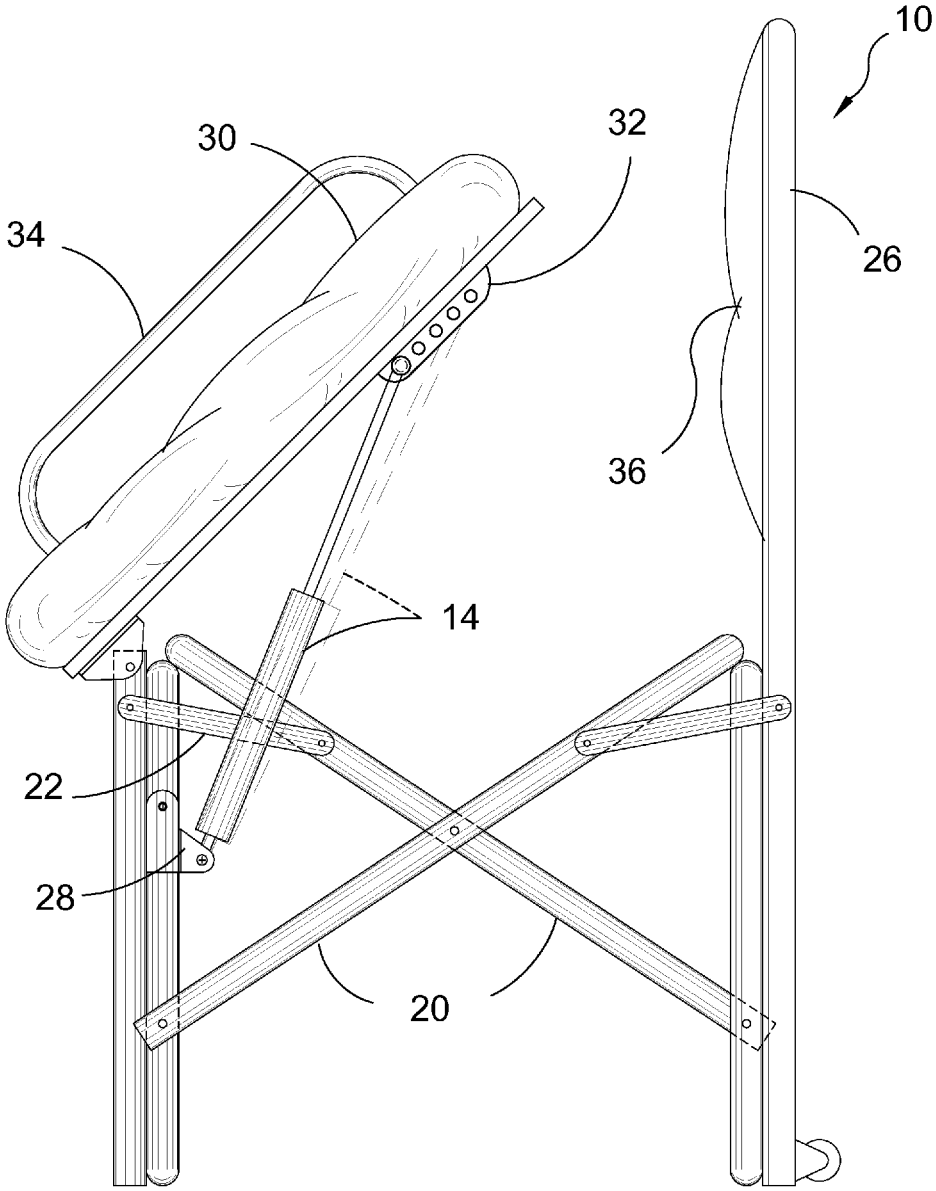
FIG. 4 is a side view of the portable lift chair.

FIG. 4 is a side view of the portable lift chair 10. Shown is the portable lift chair hydraulic or pneumatic device 14 in the operative position the seat member 30 has a positive slope providing a user with a controlled descent to a seated position and a lifting force while standing up from said chair. The hydraulic or pneumatic device 14 is connected to the front of the chair frame 26 through a linkage 22 that aids in folding the chair to its compact state and is connected to a weight adjustment bracket 32 on the backside of the seat that provides a plurality of attachment points to vary the descent and lifting rate of the seat. Handles 34 and a seat back 36 are provided for the user's comfort.

Figure 5:
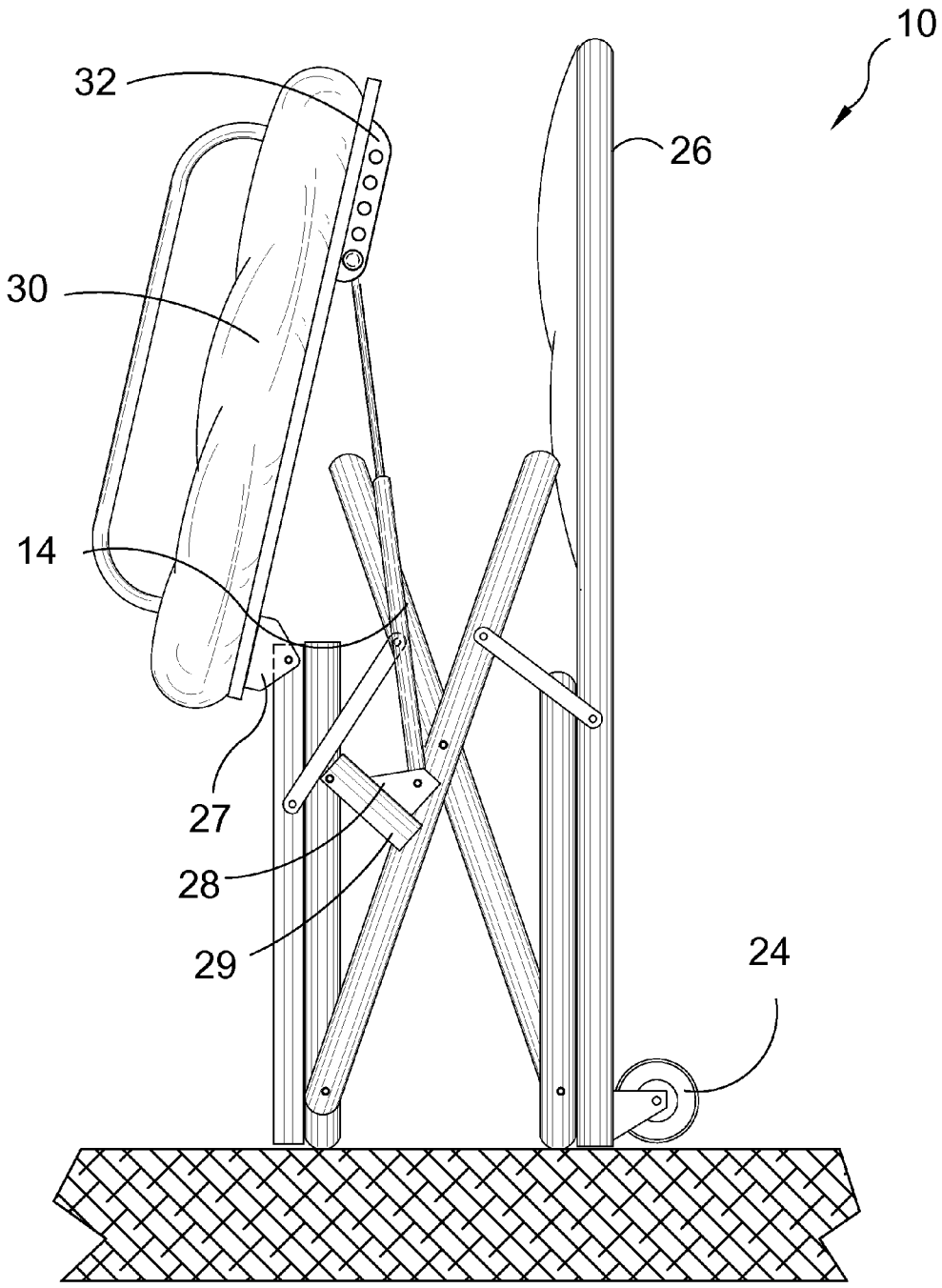
FIG. 5 is a side view of the portable lift chair folded.

FIG. 5 is a side view of the portable lift chair 10 folded. Shown is the portable lift chair in its folded position with the hydraulic or pneumatic device 14 connected to the front of the chair frame 26 through a linkage bracket 28 that aids in folding the chair to its compact state. Seat 30 is pivotally connect to frame 16 through pivotal bracket 27 and weight adjustment bracket 32. Also shown are wheels 24 so that the chair can be moved from one location to another without having to lift the chair.

Figure 6:
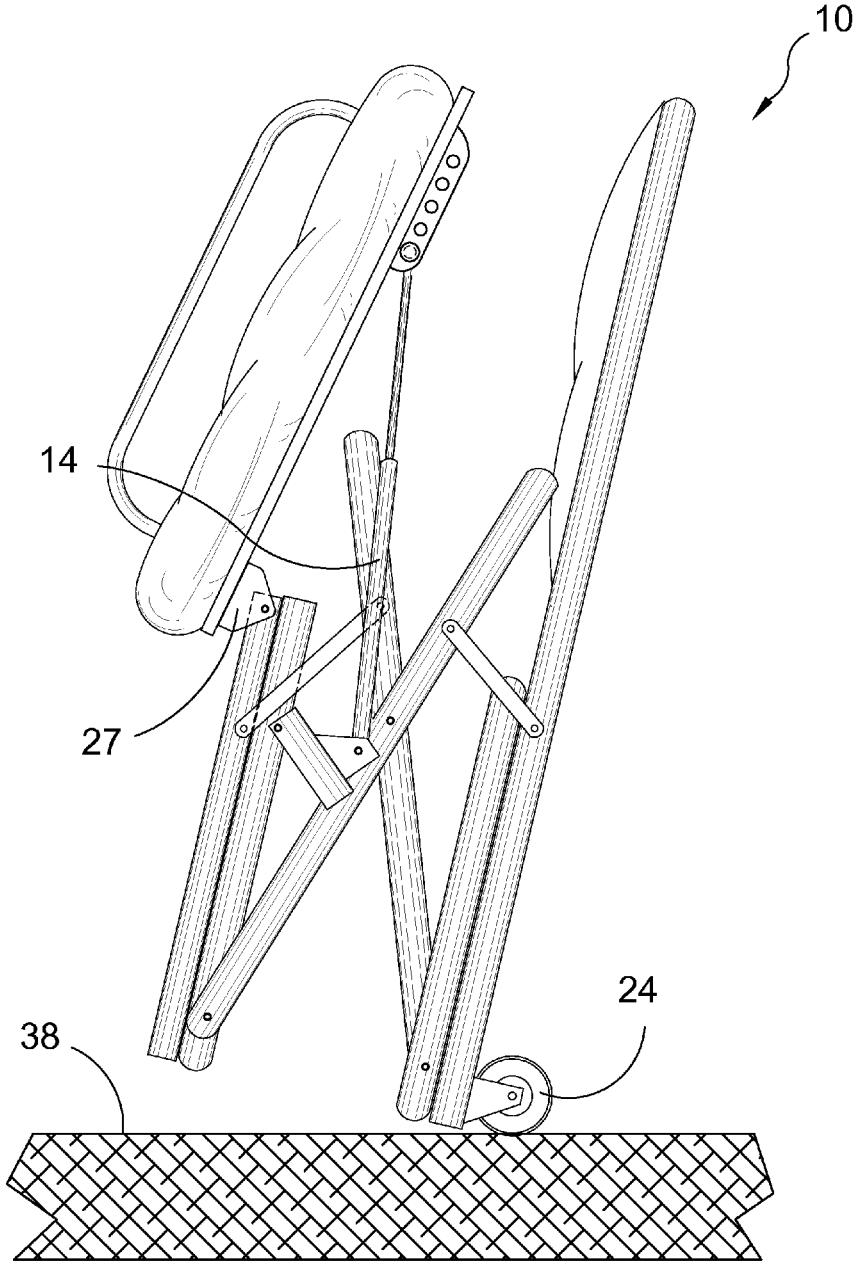
FIG. 6 is a side view of the portable lift chair folded.

FIG. 6 is a side view of the portable lift chair 10 folded. Shown is the portable lift chair in its folded position with the hydraulic or pneumatic device 14 connected to the front of the chair frame through a linkage bracket 28 that aids in folding the chair to its compact state. Also shown is the chair inclined so just the wheels 24 are in contact with the surface 38 so that the chair can be moved from one location to another without having to lift the chair.

Figure 7:
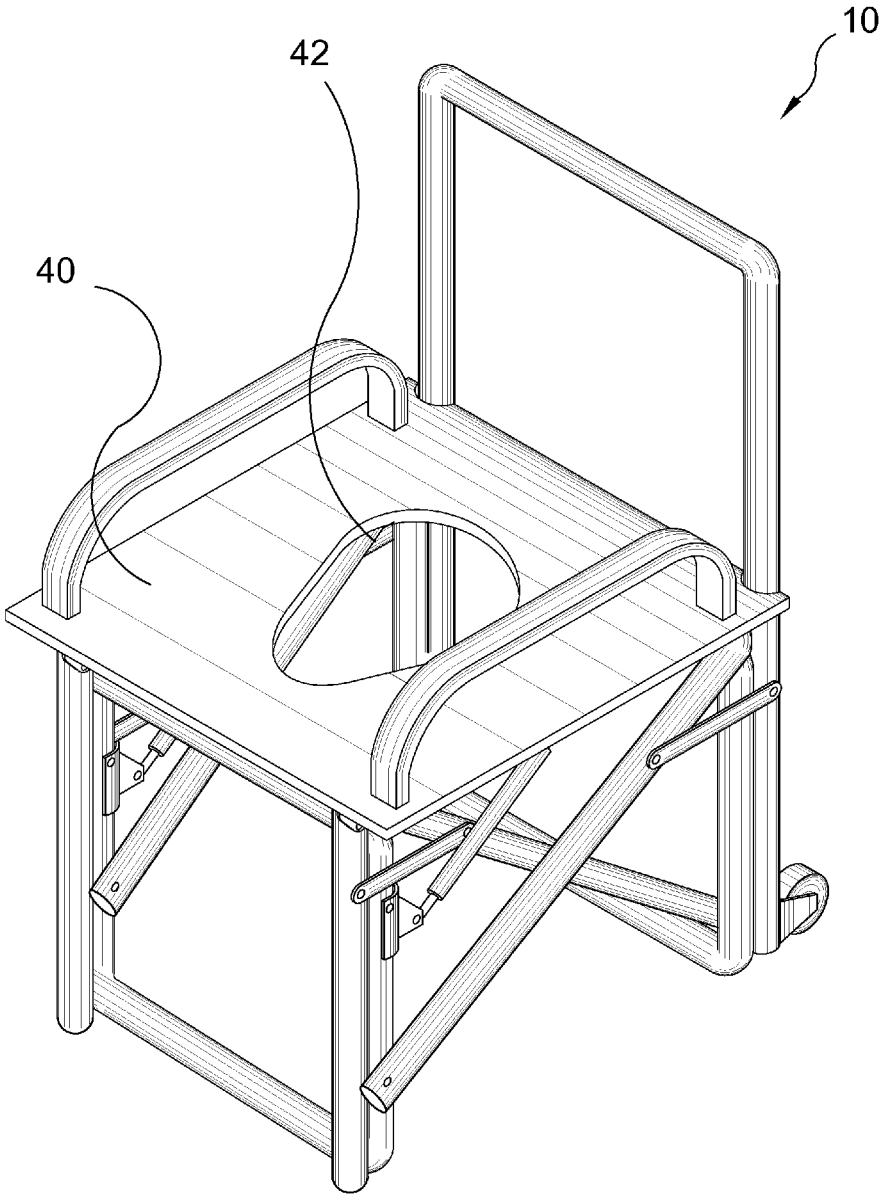
FIG. 7 is a perspective view of the portable lift chair.

FIG. 7 is a perspective view of the portable lift chair 10. The present invention provides that the seat base 40 may be detachable so that other seat types may be employed. Shown is an alternate seat base 40 having an aperture 42 therethrough for use with a bed pan, chamber pot or over a commode. It is further envisioned by the present invention that other seat and back rests may be used with the frame including cushioned, contoured and planar.

Figure 8:
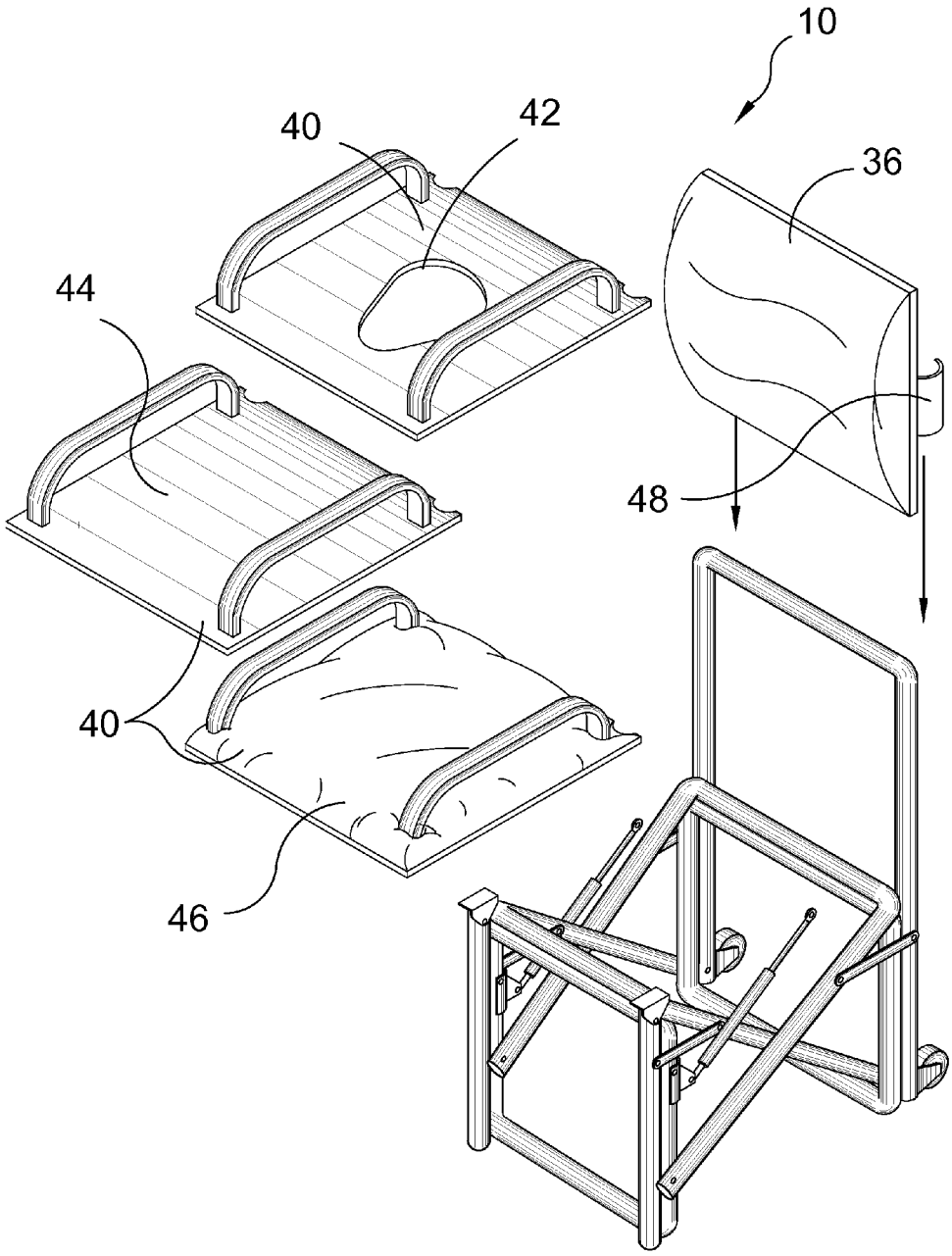
FIG. 8 is a perspective view of additional elements of the portable lift chair.

FIG. 8 is a perspective view of additional elements of the portable lift chair 10. The present invention provides that the seat may be detachable so that other seat types may be employed. Shown are alternate seat bases 40, such as cushioned 46, planar 44 and apertured 42 that can be used with a bed pan or chamber pot. It is further envisioned by the present invention that other back rests 36 may be used with the frame including cushioned, contoured and planar that may include a retainer 48 for easily mounting and dismounting various back rests from the frame.

Figure 9:
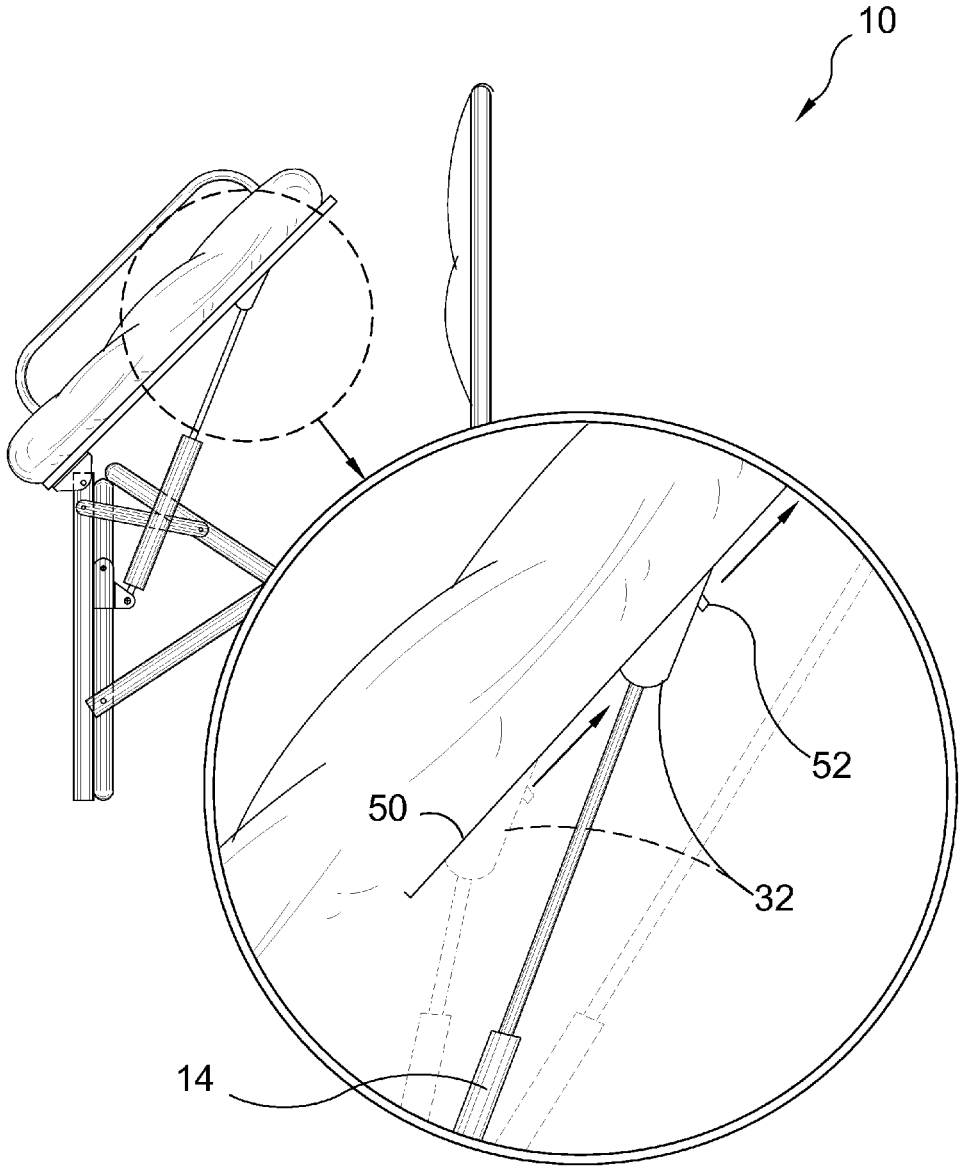
FIG. 9 is a perspective view of an alternate seat attachment for the hydraulic/pneumatic member.

FIG. 9 is a perspective view of an alternate seat attachment for the hydraulic/pneumatic member 14. The present invention 10 provides an alternate seat attachment for the hydraulic or pneumatic lifter 14 comprising a guide track 50 with an actuator 52 for moving the weight adjustment bracket 32 from one anchor point to another as desired to achieve a predetermined pressure for the seat.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A portable lift chair comprising:

a) a lightweight frame having a pair of cross members extending from opposing sides thereof from front to back in a substantially X-shaped configuration;

b) a seat base;

c) a pivotable bracket connecting a front portion of said seat base to said frame;

d) at least one pressurized cylinder providing an upward bias to a rear portion of said seat base;

e) wherein each of said at least one cylinder is positioned in a weight adjustment mechanism, each weight adjustment mechanism including a weight adjustment bracket situated on an underside of the seat base; and f) wherein each said weight adjustment mechanism further includes a guide track with an actuator for moving the weight adjustment bracket from one anchor point to another as desired to achieve a predetermined force for said seat base.

2. The portable lift chair according to claim 1, wherein said at least one pressurized cylinder is hydraulic.

3. The portable lift chair according to claim 1, wherein said at least one pressurized cylinder is pneumatic.

4. The portable lift chair according to claim 1, wherein said at least one pressurized cylinder raises the rear portion of said seat base to assist the user in rising from the seated position.

5. The portable lift chair according to claim 1, wherein said cross members on each side are pivotally secured to one another and to a front portion of said frame by a pivoting linkage.

6. The portable lift chair according to claim 1, wherein said seat base is removable.

7. The portable lift chair according to claim 6, further comprising a plurality of seat bases selected from the group consisting of padded, rigid planar, and having a central aperture to accommodate a commode.

8. The portable lift chair according to claim 1, wherein said frame further comprises a back rest.

9. The portable lift chair according to claim 8, wherein said back rest is removable and further includes a retainer that slides over said frame to prevent a casual displacement thereof.

10. The portable lift chair according to claim 1, wherein said frame can be folded accordion style when said seat base is in a raised position.

11. The portable lift chair according to claim 10, further comprising a pair of opposing wheels on a lower portion of the rear of said frame.

12. The portable lift chair according to claim 11, wherein said chair is transportable by grabbing a back rest portion of said frame, inclining said frame so all the weight is distributed to said wheels and pulling it from one location to another.

13. A portable lift chair comprising:

a) a lightweight frame having a pair of cross members extending from opposing sides thereof from front to back in a substantially X-shaped configuration, wherein said cross members are pivotally secured to one another and to a front portion of said frame by a pivoting linkage;

b) a seat base selected from the group consisting of padded, rigid planar, and having a central aperture to accommodate a commode;

c) a pivotable bracket connecting a front portion of said seat base to said frame;

d) at least one pressurized cylinder providing an upward bias to a rear portion of said seat base, wherein each of said at least one cylinder is positioned in a weight adjustment mechanism each weight adjustment mechanism including a weight adjustment bracket situated on an underside of the seat base;

e) a removable back rest; and f) the weight adjustment mechanism further includes a guide track with an actuator for moving the weight adjustment bracket from one anchor point to another as desired to achieve a predetermined pressure for said seat base.

14. The portable lift chair according to claim 13, wherein said frame can be folded accordion style when said seat base is in a raised position.

15. The portable lift chair according to claim 14, further comprising a pair of opposing wheels on the lower portion of the rear of said frame.

16. The portable lift chair according to claim 15, wherein said pressurized cylinder is selected from the group consisting of hydraulic and pneumatic.

17. A method of assisting a user in moving from a sitting to an upright position comprising the steps:

a) providing a portable lift chair comprising: a lightweight frame having a pair of cross members extending from opposing sides thereof from front to back in a substantially X-shaped configuration, wherein said cross members are pivotally secured to one another and to a front portion of said frame by a pivoting linkage; a seat base selected from the group consisting of padded, rigid planar, and having a central aperture to accommodate a commode; a pivotable bracket connecting a front portion of said seat base to said frame; at least one pressurized cylinder providing an upward bias to a rear portion of said seat base, wherein each of said at least one cylinder is positioned in a weight adjustment mechanism, each weight adjustment mechanism including a weight adjustment bracket situated on an underside of the seat base a removable back rest, said weight adjustment mechanism further includes a guide track with an actuator for moving the weight adjustment bracket from one anchor point to another as desired to achieve a predetermined pressure for said seat base;

b) sitting in said chair; and c) activating said weight adjustable pressurized cylinder to bias said rear portion of said seat base upward.

18. The method according to claim 17, further comprising the step of transporting said chair by grabbing a back rest portion of said frame, inclining said frame so all the weight is distributed to a pair of wheels and pulling said chair from one location to another.

* * * * *